US005975849A

United States Patent [19]

Yang

[11] Patent Number: 5,975,849

[45] Date of Patent: Nov. 2, 1999

[54] HANDLE STRUCTURE FOR A FLEXIBLE FAN

[75] Inventor: Ming-Shun Yang, Taipei, Taiwan

[73] Assignee: Formosa Saint Jose, Corp., Taipei, Taiwan

[21] Appl. No.: 08/977,679

[22] Filed: Nov. 24, 1997

[51] Int. Cl.[6] ..... A01M 5/08

[52] U.S. Cl. ..... 416/70 A; 416/70 R; 416/72; 416/73; 416/142; 416/146 R

[58] Field of Search ..... 416/70 A, 70 R, 416/72, 73, 71, 146 R, 142

[56] References Cited

U.S. PATENT DOCUMENTS 1,126,797 2/1915 Lichter ..... 416/70
4,911,611 3/1990 Moore ..... 416/72

*Primary Examiner*—Edward K. Look
*Assistant Examiner*—Ninh Nguyen
*Attorney, Agent, or Firm*—Erik M. Arnhem

[57] ABSTRACT

A handle structure for a flexible fan includes two corresponding holding brackets and two corresponding handle members. The holding brackets are provided at their inner sides with a plurality of receiving means and stop means so as to firmly clamp a segment of a steel wire frame of the flexible fan between the receiving and the stop means. The handle members are separately pivotally connected at one end to two ends of the holding brackets and respectively define a space for receiving two sides of the twisted and folded flexible fan therein when the fan is not in use and the handle members are pushed apart to abut against the frame of the fan. The handle members are formed with curved recesses for a comfortable grip by a the user's fingers. When the handle members are pushed to abut one another and become perpendicular to the fan, the user may stably grip the handle members to wave the fan easily.

7 Claims, 5 Drawing Sheets

HANDLE STRUCTURE FOR A FLEXIBLE FAN

BACKGROUND OF THE INVENTION

A flexible fan includes a frame made of flexible steel wire and a fabric surface spread over the flexible frame. When the fan is not subjected to any outcoming force, the steel wire frame naturally extends to a full circle. When the fan is not in use, the flexible steel wire frame can be twisted into a figure "8" and then the figure -8- shaped frame is folded into a circle with reduced volume for convenient storage and carry. Such a flexible fan can be conveniently used in watching a sports game or on a bus at any time a user feels suffers from the heat.

A drawback of this type of flexible fan is that the fan is not provided with a handle. Both the steel wire frame and the fabric surface of the fan are not rigid enough for a user to grip and wave the fan to make a somewhat strong current of air. The fabric surface is subject to slack when it is frequently gripped to wave the fan. Moreover, there is not any convenient means to effectively tie or bind the twisted and folded flexible fan when it is positioned in a pocket or handbag. Therefore, the twisted and folded flexible fan tends to fully or partially spread under a natural spring force thereof so as to undesirably expand the pocket or handbag in which it is located. This makes the pocket and/or handbag looking ugly and prevents convenient storage or access to other articles in the pocket or handbag.

SUMMARY OF THE INVENTION

It is therefore a primary object of the present invention to provide a handle structure for a flexible fan, so that the flexible fan can be firmly held at the handle structure in a working position and be stably waved to make a strong current of air, or be twisted and firmly received in the handle structure when the fan is not in use.

The handle structure for a flexible fan according to the present invention mainly includes two corresponding holding brackets and two corresponding handle members. The holding brackets are provided at their inner sides with a plurality of receiving means and stop means so as to firmly clamp a segment of the steel wire frame of the flexible fan between the receiving and the stop means. The handle members are separately pivotally connected at one end to two ends of the holding brackets and respectively define a space for receiving two sides of the twisted and folded flexible fan therein when the fan is not in use and the handle members are pushed apart to abut against the frame of the fan. The handle members are formed with curved recesses for a comfortable grip by the user's fingers. When the handle members are pushed to abut one another and become perpendicular to the fan, the user may stably grip the handle members to wave the fan easily.

DETAILED DESCRIPTION OF THE PREFERRED EMBODIMENTS

Figure 1:
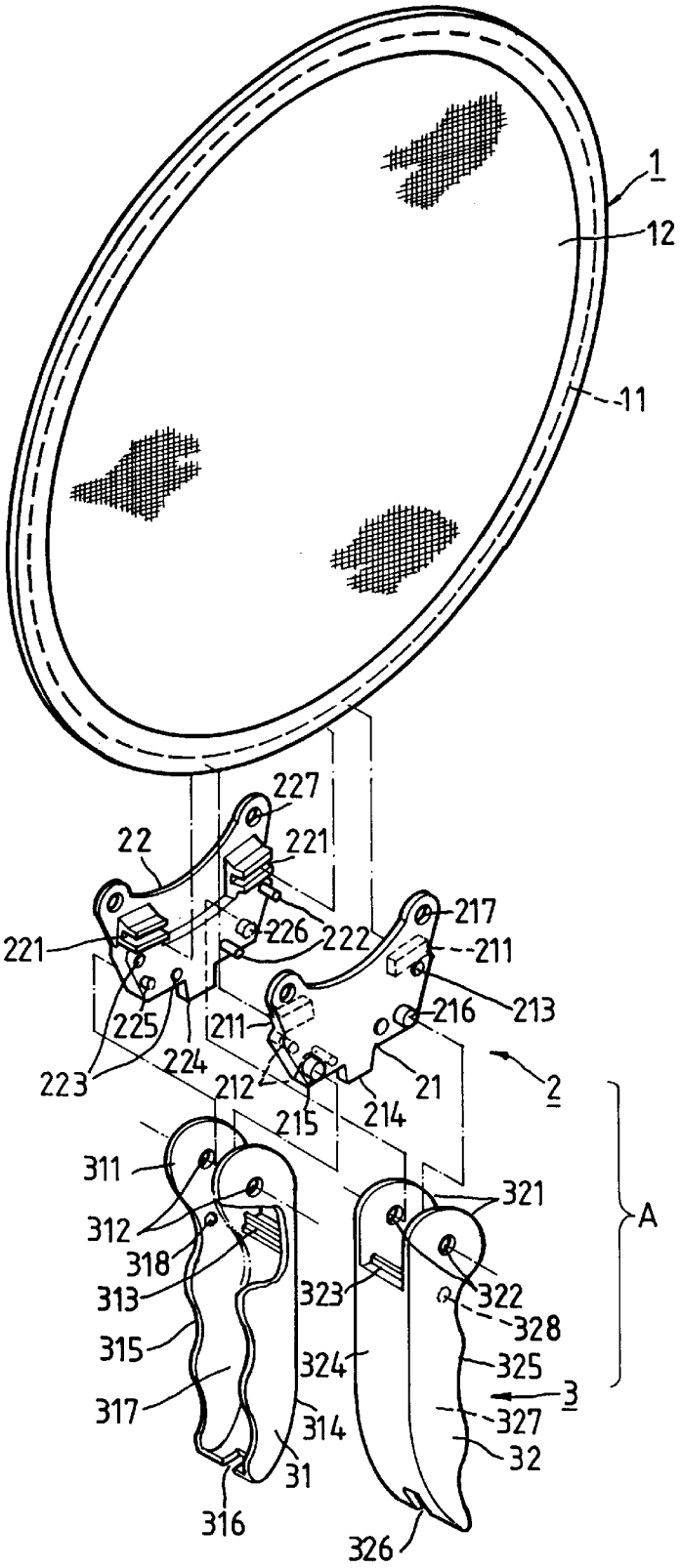
FIG. 1 is an exploded perspective of a handle structure for a flexible fan according to the present invention.

Please refer to FIG. 1, the present invention relates to a handle structure A for a flexible fan 1. The flexible fan 1 includes a frame formed from a steel wire 11 and a fabric 12 associated with the steel wire 11 by sewing.

Figure 9:
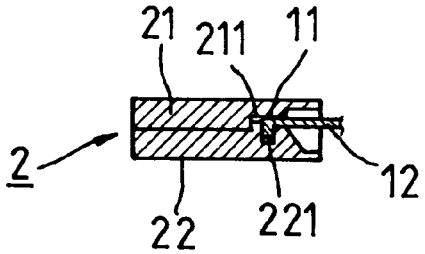
FIG. 9 is a cross sectional view taken on line C—C of FIG. 4.

Please refer to FIGS. 1 and 9 at the same time. The handle structure (A) according to the present invention includes a set of holding brackets 2 and a set of handle members 3. The set of holding brackets 2 includes a front holding bracket 21 and a rear holding bracket 22 corresponding to and cooperating with the front holding bracket 21 to clamp the steel wire frame 11 between them.

One of the holding brackets 2, for example, the rear holding bracket 22 as illustrated in FIG. 1, is provided on an inner surface with at least two receiving means 221, while the other holding bracket 2, that is, the front holding bracket 21 as illustrated in FIG. 1, is provided on an inner surface with at least two stop means 211 corresponding to the receiving means 221. A segment of the steel wire 11 of the flexible fan 1 can be set into the receiving means 221 and is retained therein by pressing and engaging the stop means 211 into the receiving means 221.

A plurality of (two are shown in FIG. 1) bars 212 and 222 project from inner surfaces of the front and the rear holding brackets 21 and 22, respectively. A plurality of fixing holes 213 and 223 are formed on the front and the rear holding brackets 21 and 22, respectively, to correspond to the bars 222 and 212, respectively, allowing the front and the rear holding brackets 21, 22 to associate with each other by inserting the bars 212 and 222 into the holes 223 and 213, respectively. Stoppers 214 and 224 resepctively project downward from a lower central portion of the front and the rear holding brackets 21 and 22 to locate the set of handle members 3 in place.

The set of handle members 3 includes a left handle member 31 and a right handle member 32. Both the left and the right handle members 31, 32 have two side walls and a back wall 314, 324, defining a U-shaped cross section and forming a space 317, 327 with an outward opening when the handle members are in a position extending away from the steel wire frame 11. One end of the left handle member 31 near the steel wire 11 forms two ear portions 311. Two holes 312 are separately formed on the ear portions 311 for two shafts 215, 225 provided at lower left corners of the holding brackets 21, 22. Similarly, one end of the right handle member 32 near the steel wire 11 forms two ear portions 321. Two holes 322 are separately formed on the ear portions 321 for two shafts 216, 226 provided at lower right corners of the holding brackets 21, 22. Whereby, the two handle members 31, 32 are allowed to pivotally turn inward or outward about the shafts 215, 225 and 216, 226, respectively, relative to the holding brackets 21 and 22.

Figure 2:
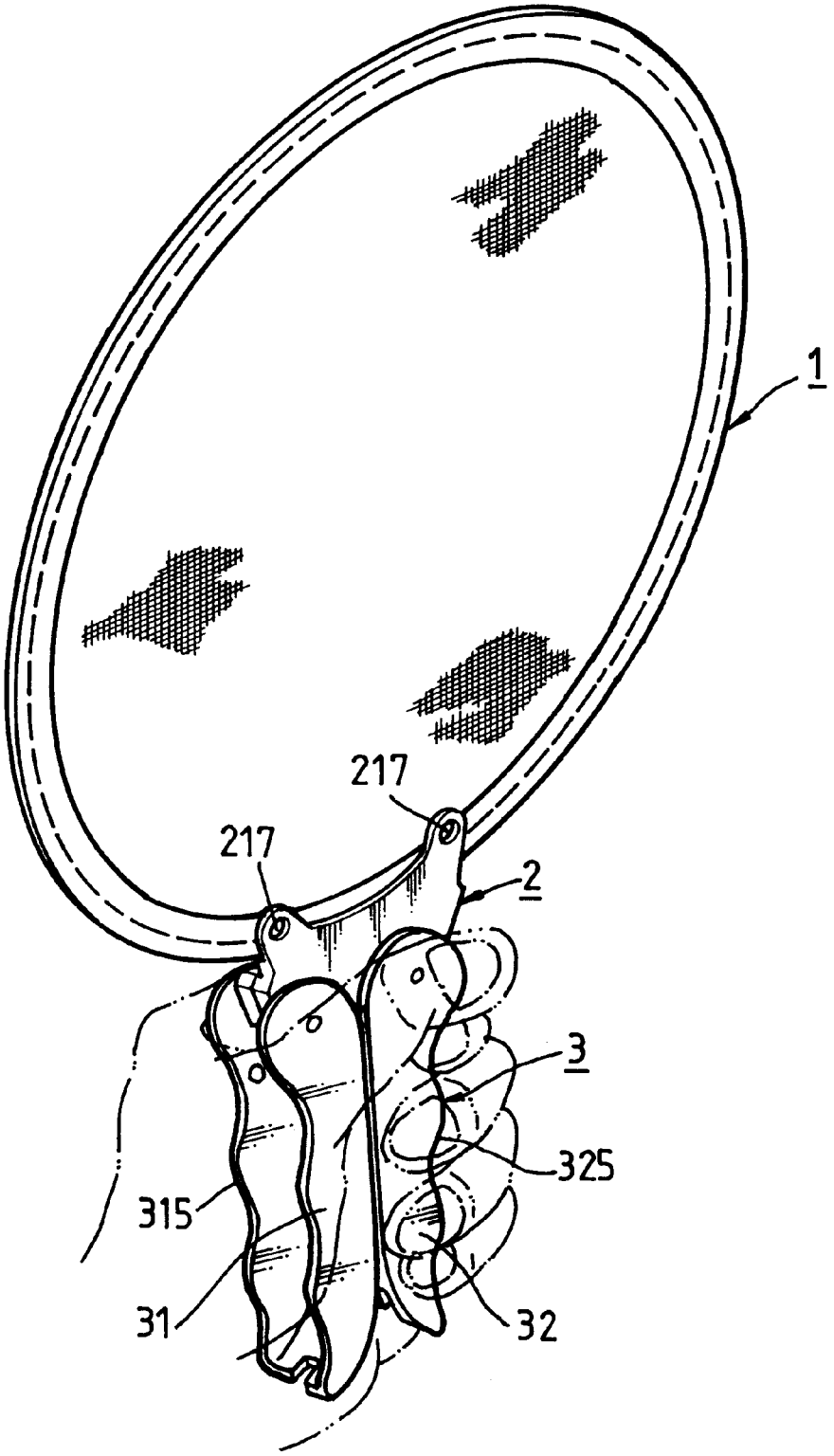
FIG. 2 is a perspective of the present invention in a first working position.

It can be seen from FIGS. 1 and 2 that the left and the right handle members are provided at inside of their back wall with a transverse stopper 313, 323, respectively, such that when the two handle members are turned away from the steel wire 11 to a position perpendicularly to the steel wire frame 11, as shown in FIG. 2, the stopper 313, 323 shall fitly press against two outer ends of the stoppers 214, 224 of the holding brackets 21, 22, respectively, without moving any further to stay in the perpendicular position. The back walls 314, 324 of the handle members 31, 32, respectively, are generally straight surfaces with a free end opposite to the ear portions 311, 321 slightly bending outward, such that when the two handle members 31, 32 are turned away from the steel wire 11 to a first working position, that is, a position perpendicular to the steel wire 11, the handle members 31, 32 abut against one another at their back walls 314, 324. The handle members 31, 32 are formed along outer edges of their side walls with a plurality of curved recesses 315, 325 for a comfortable ergonanic grip of the handle members at these recesses with the user's fingers.

When the steel wire 11 of the flexible fan 1 is twisted to a folded state, it can be contained in the spaces 317, 327 defined by the side walls and the back walls of the two handle members 31, 32. Protuberances 318, 328 are provided at inside of two side walls of the handle members 31, 32, respectively. Also, locating holes 217, 227 are formed on the holding brackets 21, 22 corresponding to the protuberances 318, 328, whereby, when the handle members 31, 32 are turned toward the twisted and folded steel wire 11 to contain two sides of the twisted steel wire 11 in the spaces 317, 327, the protuberances 318, 328 engage in the locating holes 217, 227 to hold the handle members in place without easily separating from the holding brackets 21, 22 and the twisted steel wire 11.

To use the flexible fan 1 with the handle structure of the present invention, simply turn the left and the right handle members 31, 32 away from the twisted steel wire 11 until they become perpendicular to the steel wire 11 which is now allowed to extend. At this point, the handle members 31, 32 abut aginst each other at their back walls 314, 324, and the transverse stoppers 313, 323 of the handle members press against two outer ends of the stoppers 214, 224 of the holding brackets 21, 22, holding the handle members 31, 32 in an upright position which is a first working position of the handle members 31, 32 for grip by a user to wave the fan 1.

Since the steel wire frame 11 is firmly clamped between at least two pairs of receiving means 221 and stop means 211 formed on the holding brackets 22, 21, respectively, and the handle members 31, 32 are also associated with the holding brackets 21, 22, the flexible fan 1 can be stably waved simply by gripping at the handle members.

Figure 3:
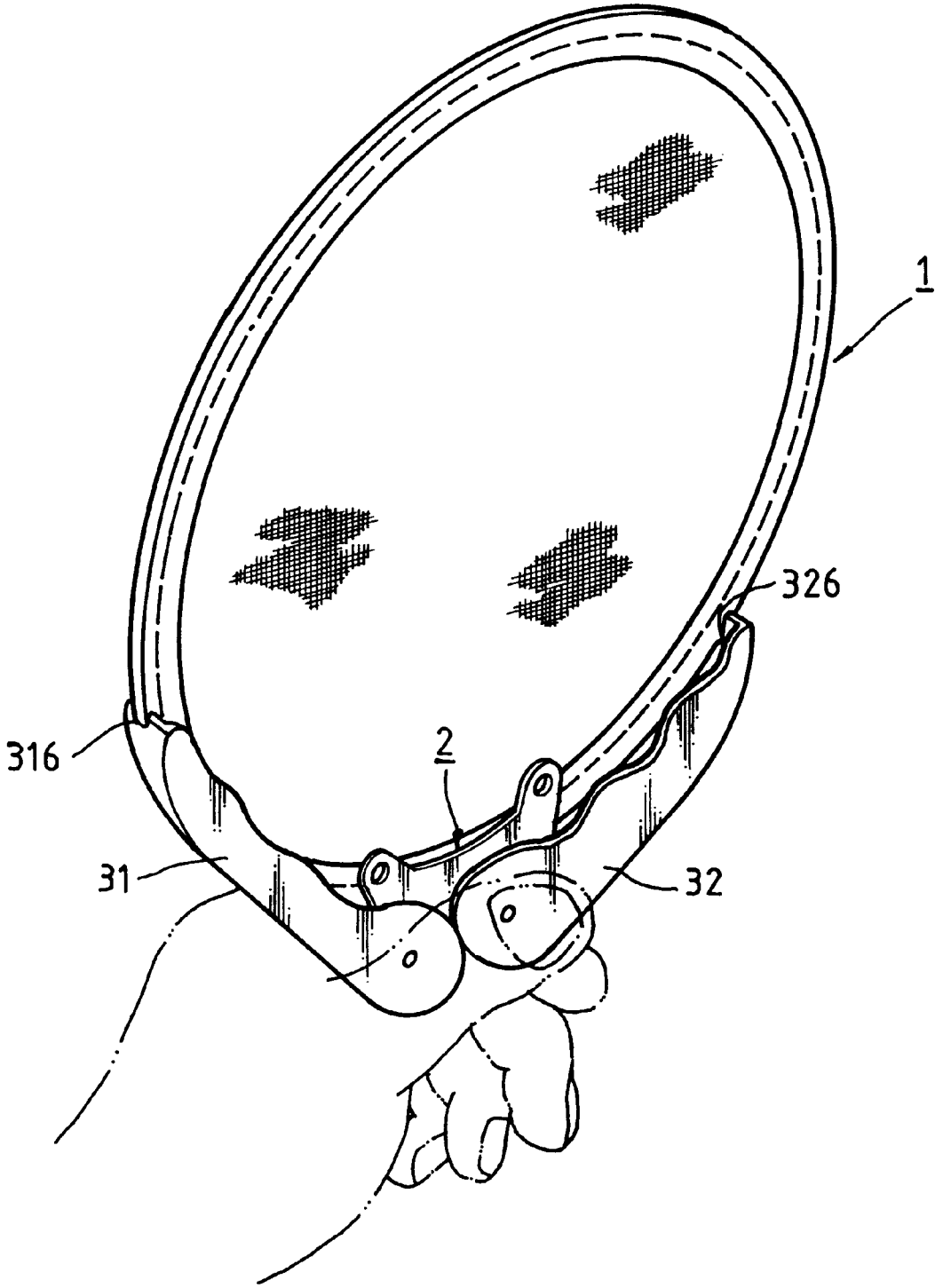
FIG. 3 is another perspective of the present invention in a second working position.

FIG. 3 illustrates another manner to use the handle structure of the present invention. As shown, the left and the right handle members 31, 32 are turned toward the fully unfolded steel wire 11 until two sides of the steel wire frame 11 are located in the spaces 317, 327 of the handle members 31, 32 and engaged into cuts (or nothes) 316, 326 respectively formed on free ends of the handle members 31, 32. At this point, the handle members 31, 32 and the fan 1 firmly associate with each other to form a united body. A user may hold the fan 1 at the handle members in this second working position to wave the fan stably.

Figure 6:
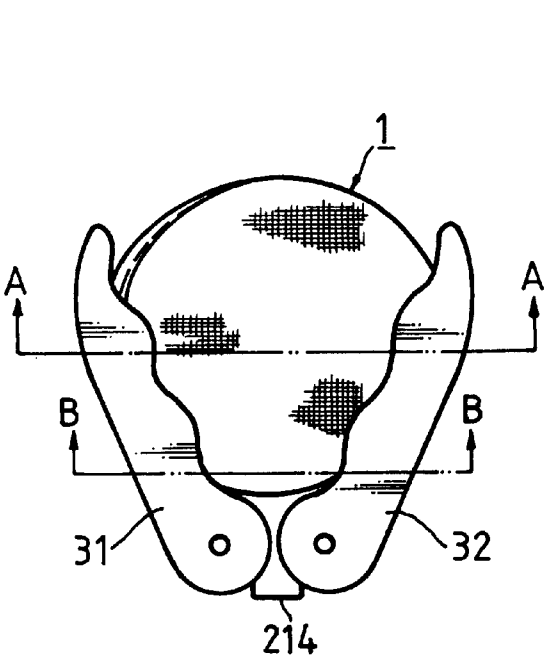
FIGS. 4 to 6 illustrate the procedures of twisting the flexible fan from a fully extended state to a fully folded state and holding the fan in the twisted state by turning two handle members of the present invention to contain the fan between them.
Figure 5:
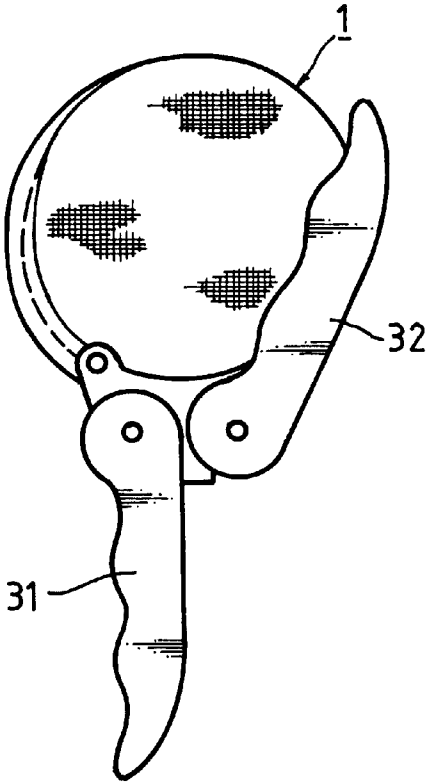
Figure 4:
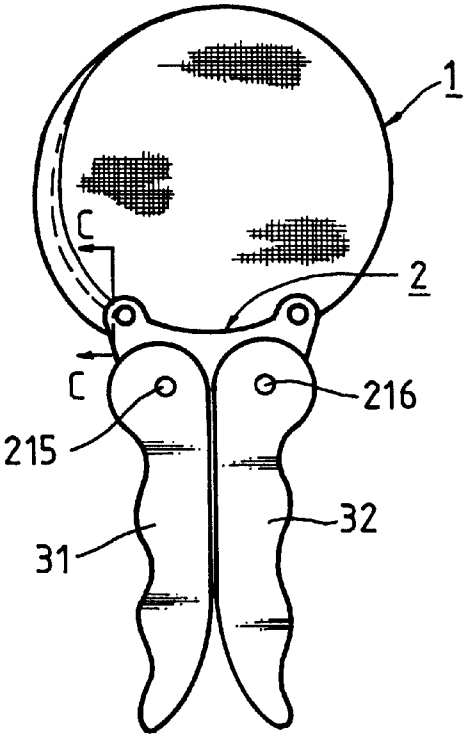
Figure 7:
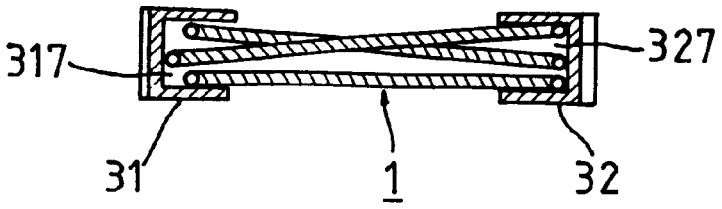
FIG. 7 is a cross sectional view taken on line A—A of FIG. 6.
Figure 8:
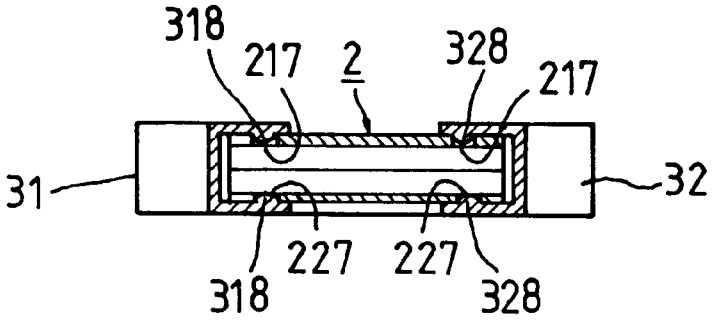
FIG. 8 is a cross sectional view taken on line B—B of FIG. 6.

To fold the flexible fan 1 to a reduced volume, simply follow the steps shown in FIGS. 4 to 8. First twist the fan 1 several times to form several superposed smaller circles, as shown in FIG. 4. Turn the left and the right handle members 31, 32 toward the twisted fan 1, as shown in FIGS. 5 and 6, so that two sides of the twisted fan 1 are contained in the spaces 317, 327 of the handle members 31, 32, as shown in FIGS. 6 and 7. Be sure that the protuberances 318, 328 inside the handle members 31, 32 engage with the locating holes 217, 227 on the holding brackets 21, 22, as shown in FIG. 8, so that the handle members 31, 32 are retained in place and the twisted flexible fan 1 is received between the handle members 31, 32 without easily extending.

With the above arrangements, the handle structure for a flexible fan according to the present invention is novel in design and convenient for operation.

What is claimed is:

1. A handle structure for a flexible fan, wherein said flexible fan includes a steel wire frame and a fabric secured to the steel wire frame by sewing, said flexible fan being adapted for twisting several times to form several relatively small continuous circles having reduced face area, said handle structure being connected to said steel wire frame and comprising;

a set of holding brackets including a front holding bracket provided at an inner side with a plurality of stop means and a rear holding bracket provided at an inner side with a plurality of receiving means corresponding to said stop means on said front holding bracket, said receiving means and said stop means together clamping a segment of said steel wire frame of said flexible fan between them and thereby associating said flexible fan with said holding brackets; and a left and a right handle member being pivotally connected to said holding brackets, so that said handle members are allowed to pivotally turn outward or inward relative to said holding brackets, and said left and said right handle members each defining a space having an outward opening for receiving therein two sides of said flexible fan in a twisted and folded form;

whereby said flexible fan is contained between said left and said right handle members without becoming loosened from the handle members.

2. A handle structure for a flexible fan as claimed in claim 1, wherein said front and said rear holding brackets are provided at inner sides thereof with a plurality of corresponding bars and fixing holes, so that said front and said rear holding brackets are associated with each other by engaging said bars into said corresponding fixing holes.

3. A handle structure for a flexible fan as claimed in claim 1, wherein said front and said rear holding brackets are each respectively formed at a central bottom portion with a downward projected stopper, and said left and said right handle members being respectively formed in said space defined by them with a transverse stopper, such that each said downward projected stopper of said holding brackets presses against each said transverse stopper of said handle members when said handle members are pushed inward to abut against each other.

4. A handle structure for a flexible fan as claimed in claim 1, wherein said handle members are formed at outer sides thereof with a plurality of curved recesses for grip by a user with fingers.

5. A handle structure for a flexible fan as claimed in claim 1, wherein said handle members have a generally straight back portion with a free end thereof bending outward.

6. A handle structure for a flexible fan as claimed in claim 5, wherein said handle members are provided at their respective free ends with a cut for said steel wire frame to pass therethrough.

7. A handle structure for a flexible fan as claimed in claim 1, wherein said handle members are provided at respective inner sides with protuberances to engage into locating holes correspondingly formed on said holding brackets.

* * * * *